US007513635B2

(12) United States Patent
Ahsan et al.

(10) Patent No.: US 7,513,635 B2
(45) Date of Patent: Apr. 7, 2009

(54) STAR AND CRESCENT STRUCTURE AND METHOD THEREOF

(75) Inventors: Aziz Mohammad Ahsan, Hopewell Junction, NY (US); Sadaf Raoof Ahsan, Hopewell Junction, NY (US); Shahzad Saeed Ahsan, Hopewell Junction, NY (US)

(73) Assignee: Dinpanah, Inc., Hopewell Junction, NY (US)

( * ) Notice: Subject to any disclaimer, the term of this patent is extended or adjusted under 35 U.S.C. 154(b) by 152 days.

(21) Appl. No.: 11/509,378

(22) Filed: Aug. 24, 2006

(65) Prior Publication Data

US 2006/0285318 A1 Dec. 21, 2006

Related U.S. Application Data

(63) Continuation-in-part of application No. 10/313,724, filed on Dec. 6, 2002, now Pat. No. 7,178,935.

(51) Int. Cl.
*F21S 6/00* (2006.01)

(52) U.S. Cl. ..... 362/121

(58) Field of Classification Search ..... None
See application file for complete search history.

(56) References Cited

U.S. PATENT DOCUMENTS

| | | | | |
|---|---|---|---|---|
| D61,416 | S | 8/1922 | Kronburger | |
| D68,108 | S | 9/1925 | Livermore | |
| 1,690,397 | A | 11/1928 | Boehland | |
| 4,918,578 | A | 4/1990 | Thompson | |
| 5,250,331 | A | 10/1993 | Grefalda | |
| 6,042,248 | A * | 3/2000 | Hannah et al. | 362/252 |
| 6,192,610 | B1 | 2/2001 | Fallon | |
| D479,763 | S | 9/2003 | Miller | |
| D483,920 | S | 12/2003 | Ahsan | |
| D494,728 | S | 8/2004 | Ahsan | |
| 6,994,448 | B1 * | 2/2006 | Gorrell | 362/183 |
| 7,178,935 | B2 * | 2/2007 | Ahsan et al. | 362/121 |
| 7,273,308 | B2 * | 9/2007 | Spero et al. | 362/560 |

OTHER PUBLICATIONS

"Muslim Symbol Gets Public Display," Islamic Society of North America Press Release, Dec. 2001.
"Crescent-and-Star Show Muslim Contributions" Poughkeepsie Journal, p. 4A, Dec. 17, 2001
"Wappinger Holiday Display is Inclusive" Poughkeepsie Journal, p. 1B, Dec. 18, 2002.
"Park Shines With 4 Religious Symbols" Poughkeepsie Journal, p. 1B, Dec. 18, 2002.
"Area Family Gets Rights to Islam Symbol" Poughkeepsie Journal, p. 5B, Jan. 1, 2004.
"Holiday Festival Takes Over Downtown" Poughkeepsie Journal, p. 1A, Dec. 4, 2004.
"City Lights Up its Night" Poughkeepsie Journal, p. 1A, Dec. 4, 2004.
"Muslim Identity Symbol" Brochure, 2005.

* cited by examiner

*Primary Examiner*—Ali Alavi
(74) *Attorney, Agent, or Firm*—Aziz M. Ahsan; Ahsan & Associates, PLLC

(57) ABSTRACT

This invention related to a star and crescent structure and method thereof. More particularly it relates to a structure comprising a star which is secured to a crescent via at least one link, and method thereof. The structure is provided with at least one internal illumination device. The structure is also provided with at least one electrical means to illuminate the structure internally.

20 Claims, 3 Drawing Sheets

STAR AND CRESCENT STRUCTURE AND METHOD THEREOF

RELATED PATENT APPLICATION

This patent application is a Continuation-in-Part of U.S. patent application Ser. No. 10/313,724, filed on Dec. 6, 2002 now U.S. Pat. No. 7,178,935, and co-pending U.S. patent application Ser. No. 11/209,411, filed on Aug. 23, 2005, and the disclosure of each is incorporated herein by reference.

FIELD OF INVENTION

This invention related to a star and crescent structure and method thereof. More particularly it relates to a structure comprising a star which is secured to a crescent via at least one link, and method thereof. The structure is provided with at least one internal illumination device. The structure is also provided with at least one electrical means to illuminate the structure internally.

BACKGROUND OF INVENTION

Different religious, cultural and social organizations have symbols and insignias to represent them. Muslims are in the process of adopting different symbols and insignias to represent them. Thus there is a need to invent symbols and insignias for the different Muslim communities.

PURPOSES AND SUMMARY OF THE INVENTION

The invention is a novel method and a star and crescent structure that can be internally illuminated.

Therefore, one purpose of this invention is to provide a star and crescent structure that can be internally illuminated, and method thereof.

Another purpose of this invention is to provide a structure comprising a star which is secured to a crescent via at least one link that can be internally illuminated, and method thereof.

Yet another purpose of this invention is to provide a structure comprising a star which is secured to a crescent via at least one link, and having at least one internal illumination means.

Still yet another purpose of this invention is to provide a structure comprising a star which is secured to a crescent via at least one link, and having at least one electrical means to illuminate the structure internally.

Therefore, in one aspect this invention comprises a star which is secured to a crescent via at least one link that can be internally illuminated, and method thereof.

In another aspect this invention comprises a structure comprising a star secured to a crescent via at least one link wherein said star has at least one internal illumination means.

In yet another aspect this invention comprises a structure comprising a star secured to a crescent via at least one link wherein said crescent has at least one internal illumination means.

In yet another aspect this invention comprises a structure comprising a star secured to a crescent via at least one link and wherein said crescent is secured to at least one base, and having at least one internal illumination means.

BRIEF DESCRIPTION OF THE DRAWINGS

The features of the invention believed to be novel and the elements characteristic of the invention are set forth with particularity in the appended claims. The drawings are for illustration purposes only and are not drawn to scale. Furthermore, like numbers represent like features in the drawings. The invention itself, however, both as to organization and method of operation, may best be understood by reference to the detailed description which follows taken in conjunction with the accompanying drawings in which:

DETAILED DESCRIPTION

A star and crescent combination symbol has been invented to represent primarily the Muslims and secondarily any and all organization that would benefit from such an invention. The crescent and a star combination symbol could be used throughout the year, and especially during the holiday season.

ISNA (Islamic Society of North America) Secretary General Dr. Sayyid M. Syeed had said "This public display of the Muslim symbol alongside the symbols of Christianity and Judaism during the holiday season . . . is a much-needed recognition, especially when other major religions and their roles in the lives of Americans are being acknowledged."

Although the crescent and star does not have any religious significance or symbolism in Islam, it will be generally accepted as a public Muslim symbol, as the crescent moon has a central function in the Muslim lunar calendar as each month starts with the sighting of the new moon.

The star can be said to represent the 5 pillars of Islam: (1) the declaration of faith; (2) the duty to pray 5 times a day; (3) giving zakat, the annual charity; (4) fasting in the month of Ramadan; and (5) performance of Hajj, the pilgrimage. The 7 points in the symbol—5 from the star and 2 from the crescent moon—may be likened to represent the 7 articles of faith for the Muslims. They are belief in (1) Allah (God), (2) Angels, (3) God's Books—the Torah, the Bible, and the Qur'an, (4) God's Messengers—Adam to Moses to Jesus to Muhammad (peace be upon them all), (5) the Day of Resurrection, (6) Destiny, and (7) Life after Death. The color white is generally recognized to symbolize peace and purity, and the color green to represent prosperity and growth.

It should be stressed that the Muslim symbol adopted in the U.S. is not meant to be an embodiment of Islam per se, and Muslims around the world may envision other designs. It should also be noted that Islam prohibits the worship of symbols or representations of any worldly structures. ISNA has also stated that any Muslim symbol has no religious significance and only represents a national Muslim identity.

Figure 1:
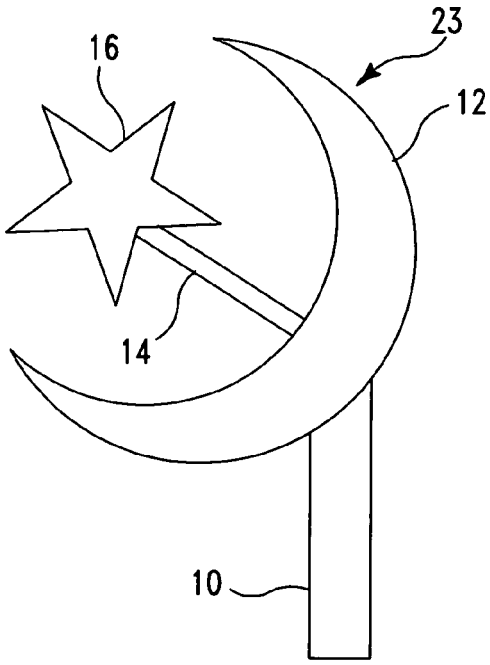
FIG. 1 illustrates a first embodiment of the invention.

FIG. 1 illustrates a first embodiment of the Muslim symbol invention 23. On a structure 10, a crescent 12 is secured. The crescent 12 has means to securely accommodate a linking structure 14. One end of the linking structure 14 is securely attached to the crescent 12, while the other end is secured to a five-point star 16. The color of the structure 10 is preferably green, while the color of the crescent 12 and the star 16 is white. The linking structure 14, can be of any color such as black, brown, to name a few. Preferably, a portion of the star 16 is within the inner radii of the crescent 12.

Figure 2:
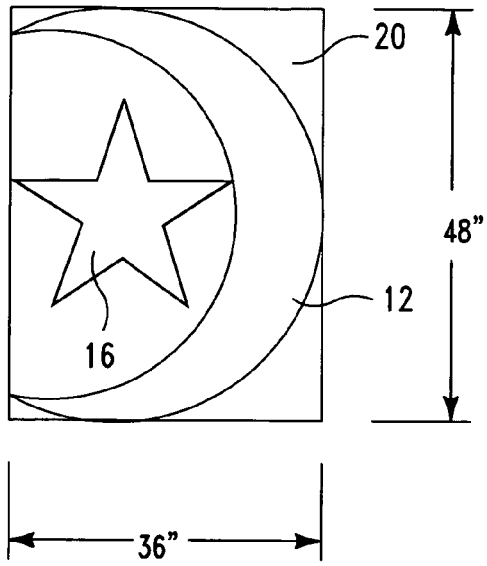
FIG. 2 illustrates a first method of making a crescent and a star.

FIG. 2 illustrates a first method of making the crescent 12 and the star 16. On a flat structure 20, such as, a piece of plywood, a wood panel, a metallic panel, a fiberglass panel, to name a few, preferably having a width of about 36 inches and a length of about 48 inches, the crescent 12 is first drawn. The five-pointed star 16 is then drawn within the area enveloped by the inner radii of the crescent 12. After both the crescent 12 and the star 16 have been marked the crescent 12 and the star 16 can be cut out of the panel structure 20 by methods well known in the art. For the ease of illustration only one flat structure 20 has been shown but it should be understood that a plurality of flat structures 20 can be underneath. Thus, a plurality of panel would yield a plurality of crescents 12 and stars 16 when the panels 20 are cut.

Figure 3:
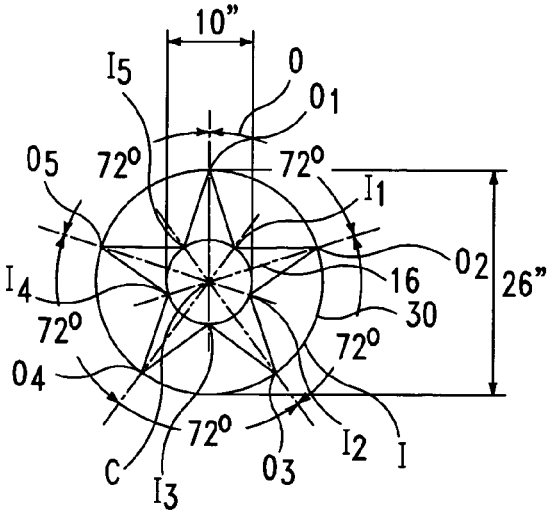
FIG. 3 illustrates a detailed method of making a star.

FIG. 3 illustrates a detailed method of making the star 16. From a center point C an outer radius of say about 13 inches is drawn thus yielding a diameter of about 26 inches for the outer circle O. An inner radius of say about 5 inches is drawn from the same center point C, thus yielding a diameter of about 10 inches for the inner circle I. A single point is chosen on the outer circle, say $O_1$ and from this single point $O_1$ four more points, such as, $O_2$, $O_3$, $O_4$ and $O_5$, are chosen on the outer circle O such that each point $O_1$, $O_2$, $O_3$, $O_4$ and $O_5$ are approximately 72 degrees away from the other point. A line is then drawn from each of the points on the outer circle $O_1$, $O_2$, $O_3$, $O_4$ and $O_5$, so that that line intersects the inner circle I at at least two different locations, thus creating points $I_1$, $I_2$, $I_3$, $I_4$ and $I_5$ on in inner circle. A line is then drawn from each of the intersecting points on the inner circle $I_1$, $I_2$, $I_3$, $I_4$ and $I_5$ to the closest points on the outer circle. Thus each intersecting point $I_1$, $I_2$, $I_3$, $I_4$ and $I_5$ on the inner circle will be connected to two different points on the outer circle, and this will result in a five-pointed star 16. The area between the inner circle I and the outer circle O that is outside of the connected lines is removed, such as, by cutting, and this will result in a stand alone five-pointed star 16.

Figure 4:
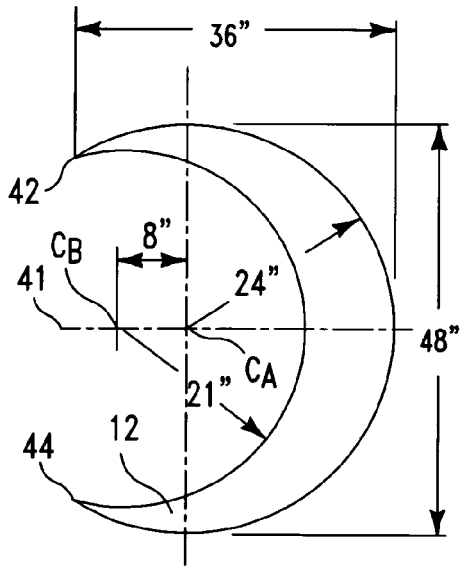
FIG. 4 illustrates a detailed method of making a crescent.

FIG. 4 illustrates a detailed method of making the crescent 12. Using a panel 20 as shown in FIG. 2, a line 41 bisecting the width is drawn. For this case, for a panel having, say a width of about 36 inches and a length of say about 48 inches will result in a line 41 that is at about 24 inches from the top and bottom edge. At a distance, such as, point $C_A$ a circle of say about 24 inches is drawn which would result in the outer edge of the crescent 12. Another circle of say about 21 inches is drawn from a point $C_B$ along the bisecting line 41 at a distance of say about 8 inches away from the first circle point $C_A$ along the bisecting line. The inner and outer circles meet in an arc, having ends 42 and 44, thus creating a crescent 12. Areas exterior to the crescent 12 are removed thus resulting in a stand-alone crescent 12.

Figure 5:
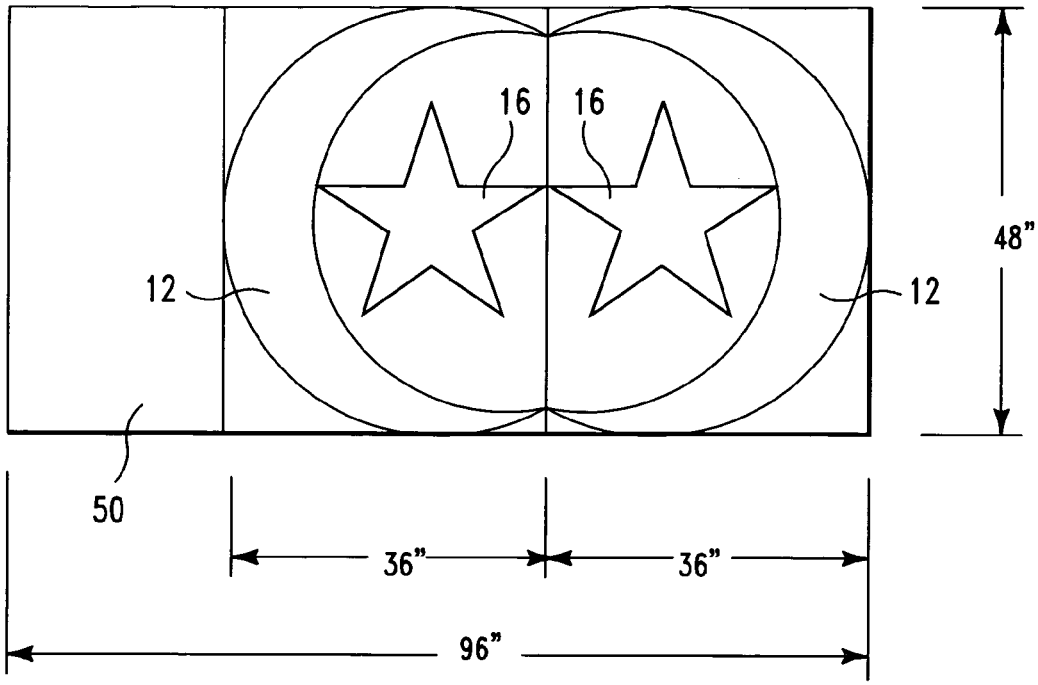
FIG. 5 illustrates a method of making plurality of crescents and stars.

FIG. 5 illustrates a method of making plurality of crescents and stars. On a larger panel 50, such as, a panel having a width of about 48 inches and a length of about 96 inches a plurality of stars 16 and crescents 12 can be obtained using the dimension discussed with reference to FIGS. 3 and 4.

Figure 6:
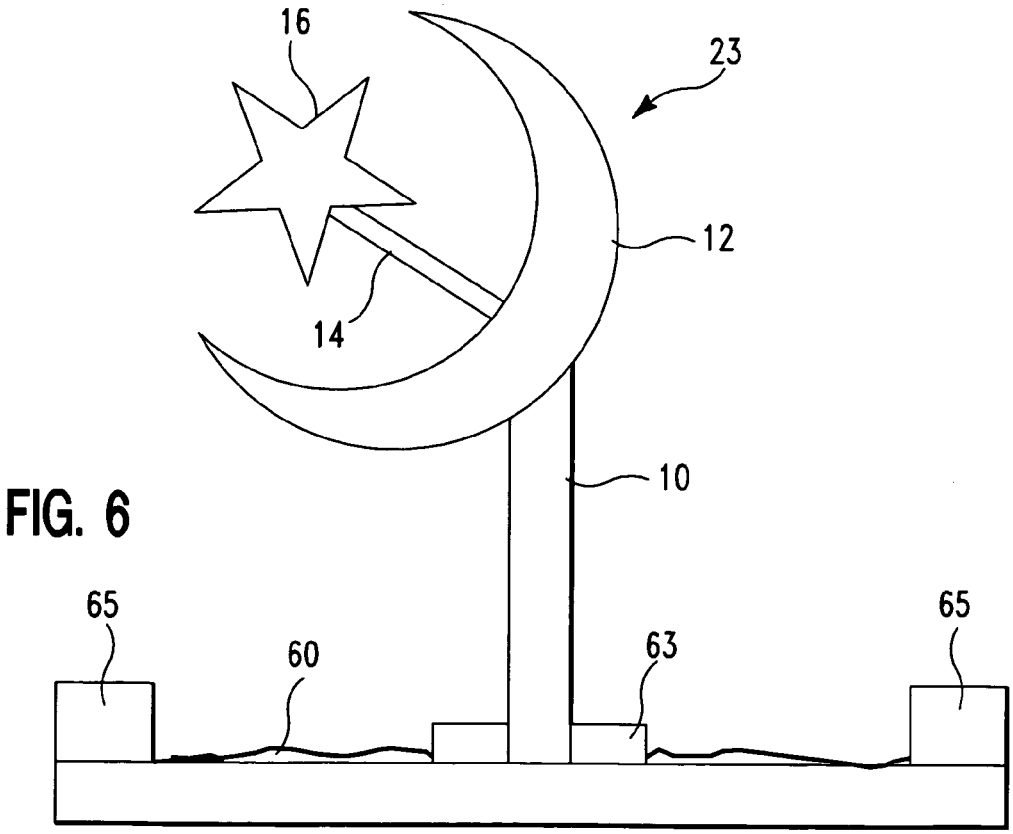
FIG. 6 illustrates a second embodiment of the invention.

FIG. 6 illustrates a second embodiment of the invention. The structure 10, having the star 16 secured to the crescent 12 with the link 14 is secured to another structure 63. The structure 63 could be the Earth, a flat panel, a base, a pedestal, or any support structure, to name a few. In order to illuminate the Muslim symbol 23 at least one illumination device 65 is provided. The illumination device 65 can be secured to a separate base or a structure or could be secured to a portion of the structure 63. Electrical wires 60 could also be provided to provide power to the illumination device 65. The illumination device 65, could be selected from a group consisting of outdoor light, indoor light, flood light, halogen light, fog light, fiber optic light, to name a few.

Figure 7:
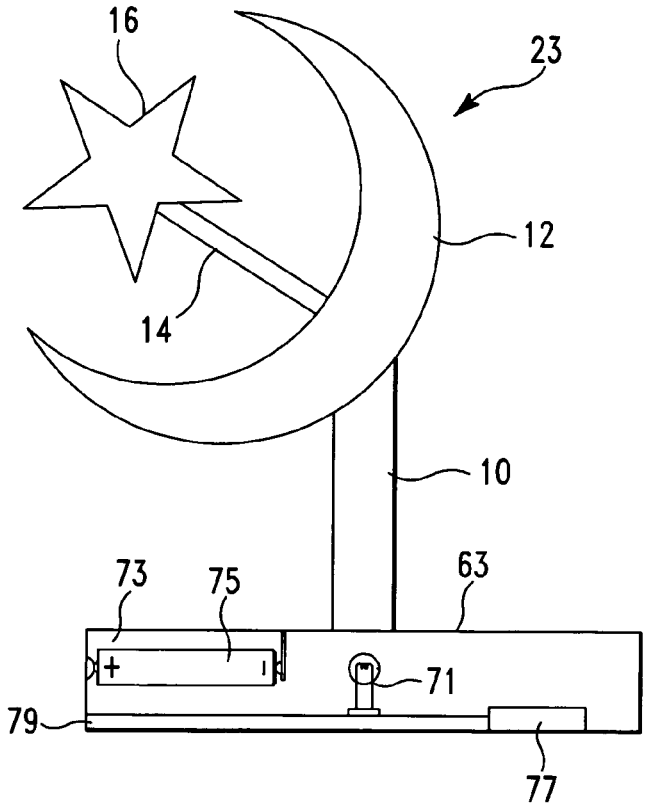
FIG. 7 illustrates a third embodiment of the invention.

FIG. 7 illustrates a third embodiment of the invention. The base 63, has a base opening or compartment 73, to accommodate at least one light emitting device 71, at least one power source 75, for the light emitting device 71, and a control switch 77, for the light emitting device 71, and a cover 79, to open or securely close the base opening or compartment 73. Once the power is supplied to the light emitting device 71, the light emitting device 71, illuminates within the base 63. However, the light from the light emitting device 71, can travel internally to the star 16, via the linking structure 14, the crescent 12, and the structure 10. For the light to travel internally it is preferred that the star 16, the linking structure 14, the crescent 12, and the structure 10, are made from a material that allows the light to travel internally. However, the Muslim Symbol 23, could be provided with at least one optical fiber and/or at least one light pipe within the structure 10, and/or the linking structure 14, such that the structure 10, and/or the linking structure 14, internally do not light up but that the star 16, and/or the crescent 12, light-up from the light supplied from the light emitting device 71, via the optical fiber and/or light pipe within the structure 10 and/or 14. In some cases the structure 10 and/or the linking structure 14, can itself be a light pipe.

Figure 8:
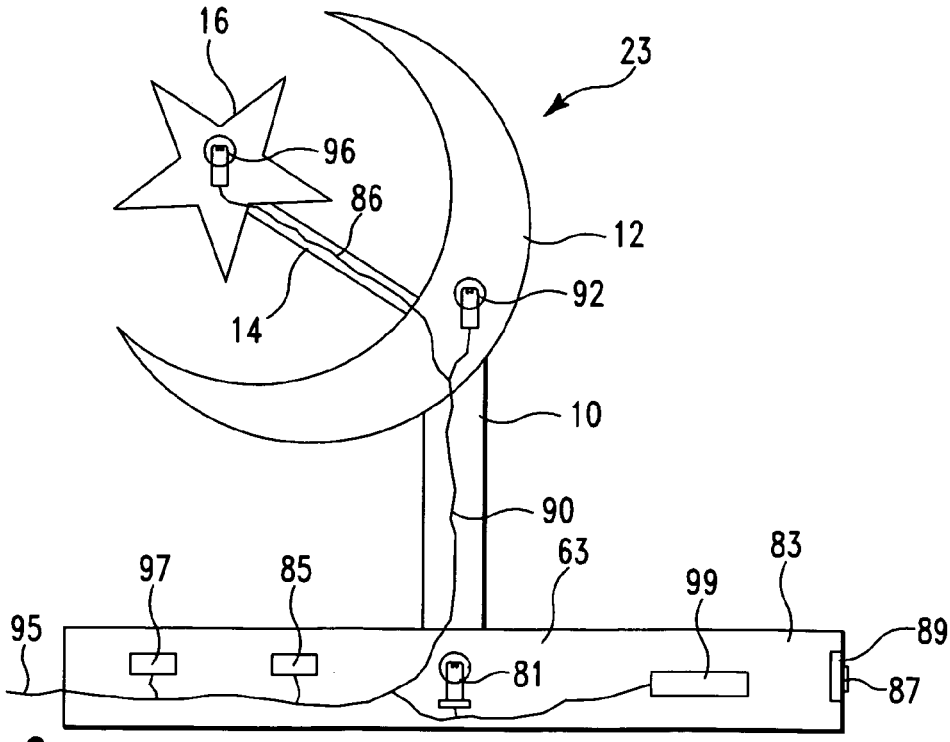
FIG. 8 illustrates a fourth embodiment of the invention.

FIG. 8 illustrates a fourth embodiment of the invention. The base 63, has a base opening or compartment 83, to accommodate at least one light emitting device 81, at least one power source 85, for the light emitting device 81, and a control switch 87, for the light emitting device 81, and a cover 89, to open or securely close the base opening or compartment 83. It is preferred that the crescent 12, has at least one internal opening to accommodate at least one light emitting device 92. It is also preferred that the star 16, has at lease one internal opening to accommodate at least one light emitting device 96. Once the power is supplied to the light emitting devices 81, 92 and 96, the light emitting device 81, illuminates within the base 63. However, the light from the light emitting devices 81, 92 and 96, can travel internally to the star 16, via the linking structure 14, the crescent 12, and the structure 10. For the light to travel internally it is preferred that the star 16, the linking structure 14, the crescent 12, and the structure 10, are made from a material that allows the light to travel internally. The base 63, could also be provided with at least one control means 97, to control the individual and/or combined illumination of the light emitting devices 81 and/or 92 and/or 96, or to control the individual and/or combined illumination intensity of the light emitting devices 81 and/or 92 and/or 96, or to control the individual and/or combined sequence of illumination of the light emitting devices 81 and/or 92 and/or 96. The at least one control means 97, also has at least one means to control at least one device 99. However, the Muslim Symbol 23, could be provided with at least one optical fiber and/or at least one light pipe within the structure 10, and/or the linking structure 14, such that the structure 10, and/or the linking structure 14, internally do not light up but that the star 16, and/or the crescent 12, light-up from the light supplied from the light emitting device 81 and/or 92 and/or 96, via at least one optical fiber and/or at least one light pipe within the structure 10 and/or 14. The Muslim Symbol 23, could also be supplied with wire means 95, to supply power from an external source (not shown) to the electronic items within the base 63. Electrical wires 86 and 90, supply power to the light emitting device 96 and 92, respectively.

The control switch 77 or 87, is preferable a off/on switch or a variable-type switch that can be used to either gradually or intermittently increase or gradually or intermittently decrease the power supplied to the light emitting device 71, 81 and/or 92 and/or 96.

The power source 75 or 85, can be selected from a group comprising, a battery, an AC power source or a DC power source.

The light emitting device 71, 81, 92 and 96, is selected from a group comprising an incandescent-type bulb, a fluorescent-type bulb, a halogen-type bulb, a sodium-type bulb, an LED or variations thereof, to name a few. The light emitting device 71, 81, 92 and 96, can have different color and wattage.

The base 63, could be made so as to accommodates a group consisting of at least one internal illumination means 81, at least one power source 85, at least one control means 97, at least one audio device 99, at least one speaker 99, at least one recording device 99, at least one audio transmission device 99, at least one communication device 99, at least one timing device 99, at least one clock 99, at least one decorative device 99, to name a few.

At least one material for at least one component of the Muslim Symbol 23, can be selected from a group comprising, a transparent material, a translucent material, a plastic material, an opaque material, a glow-in-the-dark material, a wood material, a metallic material, a marble-type material, a fiberglass material, a glass material, and materials of wood, cork, reed, cane, wicker, horn, bone, ivory, whalebone, shell, amber, mother-of-pearl, meerschaum, plastics, and substitutes for all these materials, to name a few.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A structure comprising a star secured to a crescent via at least one link wherein said star has at least one internal illumination means.

2. The structure of claim 1, wherein said at least one internal illumination means is selected from a group consisting of an incandescent-type bulb, a fluorescent-type bulb, a halogen-type bulb, a sodium-type bulb, and an LED.

3. The structure of claim 1, wherein electrical power to said at least one internal illumination means is selected from a group consisting of a battery, an AC power source and a DC power source.

4. The structure of claim 1, wherein electrical power to said at least one internal illumination means is controlled be at least one switch.

5. The structure of claim 1, wherein electrical power to said at least one internal illumination means is controlled be at least one switch, and wherein said switch is selected from a group consisting of an off/on switch and a variable-type switch.

6. A structure comprising a star secured to a crescent via at least one link wherein said crescent has at least one internal illumination means.

7. The structure of claim 6, wherein said at least one internal illumination means is selected from a group consisting of an incandescent-type bulb, a fluorescent-type bulb, a halogen-type bulb, a sodium-type bulb, and an LED.

8. The structure of claim 6, wherein electrical power to said at least one internal illumination means is selected from a group consisting of a battery, an AC power source and a DC power source.

9. The structure of claim 6, wherein electrical power to said at least one internal illumination means is controlled be at least one switch.

10. The structure of claim 6, wherein electrical power to said at least one internal illumination means is controlled be at least one switch, and wherein said switch is selected from a group consisting of an off/on switch and a variable-type switch.

11. A structure comprising a star secured to a crescent via at least one link and wherein said crescent is secured to at least one base, and having at least one internal illumination means.

12. The structure of claim 11, wherein said base has at least one compartment.

13. The structure of claim 11, wherein said base has at least one compartment, and wherein said compartment accommodates a group consisting of at least one internal illumination means, at least one power source, at least one control means, at least one audio device, at least one speaker, at least one recording device, at least one audio transmission device, at least one communication device, at least one timing device, at least one clock and at least one decorative device.

14. The structure of claim 11, wherein said base has at least one internal illumination means.

15. The structure of claim 11, wherein said at least one internal illumination means is present in a group consisting of said base, said star and said crescent.

16. The structure of claim 11, wherein said at least one internal illumination means is selected from a group consisting of an incandescent-type bulb, a fluorescent-type bulb, a halogen-type bulb, a sodium-type bulb, and an LED.

17. The structure of claim 11, wherein electrical power to said at least one internal illumination means is selected from a group consisting of a battery, an AC power source and a DC power source.

18. The structure of claim 11, wherein electrical power to said at least one internal illumination means is controlled be at least one switch.

19. The structure of claim 11, wherein electrical power to said at least one internal illumination means is controlled be at least one switch, and wherein said switch is selected from a group consisting of an off/on switch and a variable-type switch.

20. The structure of claim 11, wherein at least one light pipe channels illumination from said at least one internal illumination means.

* * * * *